US010490939B2

(12) United States Patent
Shinmi

(10) Patent No.: US 10,490,939 B2
(45) Date of Patent: Nov. 26, 2019

(54) LEVER-TYPE CONNECTOR

(71) Applicant: Yazaki Corporation, Minato-ku, Tokyo (JP)

(72) Inventor: Yoshifumi Shinmi, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/868,093

(22) Filed: Jan. 11, 2018

(65) Prior Publication Data

US 2018/0248311 A1 Aug. 30, 2018

(30) Foreign Application Priority Data

Feb. 28, 2017 (JP) ..... 2017-036757

(51) Int. Cl.
*H01R 13/62* (2006.01)
*H01R 13/629* (2006.01)
(Continued)

(52) U.S. Cl.
CPC . *H01R 13/62938* (2013.01); *H01R 13/62955* (2013.01); *H01R 24/20* (2013.01); *H01R 24/28* (2013.01); *H01R 2107/00* (2013.01)

(58) Field of Classification Search
CPC ..... H01R 13/62938; H01R 13/62955; H01R 24/20; H01R 24/28; H01R 2107/00
(Continued)

(56) References Cited

U.S. PATENT DOCUMENTS 5,458,496 A * 10/1995 Itou ..... B60L 11/1818 439/34
5,577,920 A * 11/1996 Itou ..... B60L 11/1818 439/310
(Continued)

FOREIGN PATENT DOCUMENTS

CN 104584335 A 4/2015
JP 2002-134223 A 5/2002
(Continued)

OTHER PUBLICATIONS

Mar. 21, 2019—(CN) The First Office Action—App 2018101590023, Eng Tran.
(Continued)

*Primary Examiner* — Abdullah A Riyami
*Assistant Examiner* — Vladimir Imas
(74) *Attorney, Agent, or Firm* — Banner & Witcoff, Ltd.

(57) ABSTRACT

A lever-type connector includes a first housing and a second housing which are capable of being fitted to each other; and a lever mounted on the second housing. The first housing includes a first terminal storage chamber capable of storing a first terminal therein, and a cam boss which moves together with the first housing in a fitting direction when the first housing and the second housing are fitted to each other. The second housing includes a second terminal storage chamber capable of storing a second terminal therein. The lever includes a cam groove capable of receiving the cam boss. The lever approximates the first housing and the second housing to each other and brings the first terminal and the second terminal into press contact with each other while moving the cam boss along the cam groove.

6 Claims, 8 Drawing Sheets

(51) Int. Cl.
*H01R 24/20* (2011.01)
*H01R 24/28* (2011.01)
*H01R 107/00* (2006.01)

(58) Field of Classification Search
USPC ..... 439/261, 157
See application file for complete search history.

(56) References Cited

U.S. PATENT DOCUMENTS 5,709,560 A * 1/1998 Hio ..... H01R 13/62933 439/157
5,816,643 A * 10/1998 Itou ..... B60L 11/1818 296/97.22
5,904,583 A * 5/1999 Katsuma ..... H01R 13/62933 439/157
6,190,187 B1 * 2/2001 Okabe ..... H01R 13/6275 439/157
6,203,340 B1 * 3/2001 Yamashita ..... H01R 13/62938 439/157
6,325,647 B1 * 12/2001 May ..... H01R 13/6295 439/157
6,558,176 B1 * 5/2003 Martin ..... H01R 13/62944 439/157
7,104,819 B2 * 9/2006 Yamaoka ..... H01R 13/62938 439/153
7,329,133 B2 * 2/2008 Ishikawa ..... H01R 13/62938 439/140
7,364,453 B2 4/2008 Matsuura et al.
7,445,491 B2 * 11/2008 Fujii ..... H01R 13/62938 439/157
9,077,106 B2 * 7/2015 Suzuki ..... H01R 13/6272
9,106,000 B2 * 8/2015 Mizutani ..... H01R 13/4365
9,595,784 B2 * 3/2017 Kataoka ..... H01R 13/5205
9,972,937 B2 * 5/2018 Akagi ..... H01R 13/516
RE46,950 E * 7/2018 Ishibashi ..... C22C 21/00
2007/0298637 A1 12/2007 Matsuura et al.
2015/0137756 A1 5/2015 Fukushima et al.

FOREIGN PATENT DOCUMENTS

JP 2004-303440 A 10/2004
JP 2008-034336 A 2/2008
JP 2009-093930 A 4/2009
JP 2009-117059 A 5/2009
JP 2011-023127 A 2/2011
JP 2012-238472 A 12/2012
JP 2015-133204 A 7/2015

OTHER PUBLICATIONS

Mar. 5, 2019—(JP) Notification of Reasons for Refusal—App 2017-036757.

* cited by examiner

LEVER-TYPE CONNECTOR

CROSS REFERENCE TO RELATED APPLICATIONS

This application claims priority from Japanese Patent Application No. 2017-036757 filed on Feb. 28, 2017, the entire contents of which are incorporated herein by reference.

BACKGROUND OF THE INVENTION

Field of the Invention

The invention relates to a lever-type connector which comprises a first housing and a second housing fittable to each other, and a lever mounted on the second lever.

Description of Related Art

Conventionally, there is proposed a lever-type connector comprising a lever which assists in the fitting of a male housing and a female housing.

For example, in one of conventional lever-type connectors, a lever is rotatably mounted on one housing and a projecting pin is provided in the other housing. And, in a state where the projecting pin is inserted into a cam hole formed in the lever, by rotating the lever, both housings are drawn to each other to be fitted to each other.

[Patent Document 1] JP-A-2009-117059

[Patent Document 2] JP-A-2012-238472

[Patent Document 3] JP-A-2008-034336

According to a related art, a lever-type connector is generally configured such that, in a fitting, while drawing both housings to each other by rotating a lever, a terminal (for example, a male terminal) stored in one housing is pressed into contact with a terminal (for example, a female terminal) stored in the other housing. Thus, in the fitting, it is required to exert on the lever both of a force for drawing both housings (for example, a frictional force produced during the sliding motion of both housings, and a frictional force produced during the sliding motion of both terminals) and a force for pressing both terminals into contact with each other (for example, a force for pressing the male terminal into the female terminal). Such force to be exerted on the lever in the fitting, for convenience, is hereinafter called a [fitting force].

Particularly, in the case that the number of terminals to be stored in the housing is large (the number of poles is large), a large number of terminals must be press contacted and the housing itself is also increased in size, whereby the above fitting force tends to increase. However, even in this case, it is desirable to improve the fitting workability as much as possible.

SUMMARY

One or more embodiments provide a lever-type connector excellent in the fitting workability.

In an aspect (1), a lever-type connector includes a first housing and a second housing which are capable of being fitted to each other; and a lever mounted on the second housing. The first housing includes a first terminal storage chamber capable of storing a first terminal therein, and a cam boss which moves together with the first housing in a fitting direction when the first housing and the second housing are fitted to each other. The second housing includes a second terminal storage chamber capable of storing a second terminal therein. The lever includes a cam groove capable of receiving the cam boss. The lever approximates the first housing and the second housing to each other and brings the first terminal and the second terminal into press contact with each other while moving the cam boss along the cam groove. The cam boss and the cam groove are brought into contact with each other, before the first terminal and the second terminal are press contacted with each other.

In an aspect (2), the cam boss has an elliptical cross-sectional shape in which a major diameter extends along the fitting direction.

According to the aspect (1), in fitting, before the first and second terminals are pressed into contact with each other, the cam boss comes into contact with the cam groove of the lever. In other words, the timing when the fitting force is increased due to the start of the press contact of the terminals with each other and the timing when the fitting force is increased because the first and second housings are drawn to each other by cooperation between the cam boss and lever can be made different (can be shifted) from each other. Therefore, the degree of an increase in the fitting force (the increase ratio) can be reduced when compared with a case where the two timings coincide with each other (a case where the force for pressing the terminals into contact with each other and the force for drawing the housings to each other are required at the same time).

Therefore, the lever-type connector of this configuration is excellent in the fitting workability.

According to the aspect (2), in an example where the timing for starting the press contact between the terminals and the timing for starting to draw the two housings to each other are made different (are shifted) form each other, the section shape of the cam boss (the shape of the section of the cam boss orthogonal to the projecting direction of the cam boss) is an elliptical shape the major diameter of which extends in the fitting direction. Therefore, when compared with a case where the section shape of the cam boss is a perfect circle, the timing of the contact of the cam boss with the cam groove of the lever can be advanced.

Therefore, according to the lever-type connector of this configuration, without changing the design about the position of the cam boss and the structure of the terminal storage chamber, only by changing the design of the shape of the cam boss, the two timings can be made different (can be shifted) from each other.

According to one or more embodiments, a lever-type connector excellent in fitting workability can be provided.

One or more embodiments has been described heretofore briefly. Further, when the mode for carrying out the invention to be described below is read through with reference to the accompanying drawings, the details of the invention will be clarified further.

DETAILED DESCRIPTION

<Embodiment>

Description is given below of a lever-type connector 1 according to an embodiment of the invention.

Figure 1A:
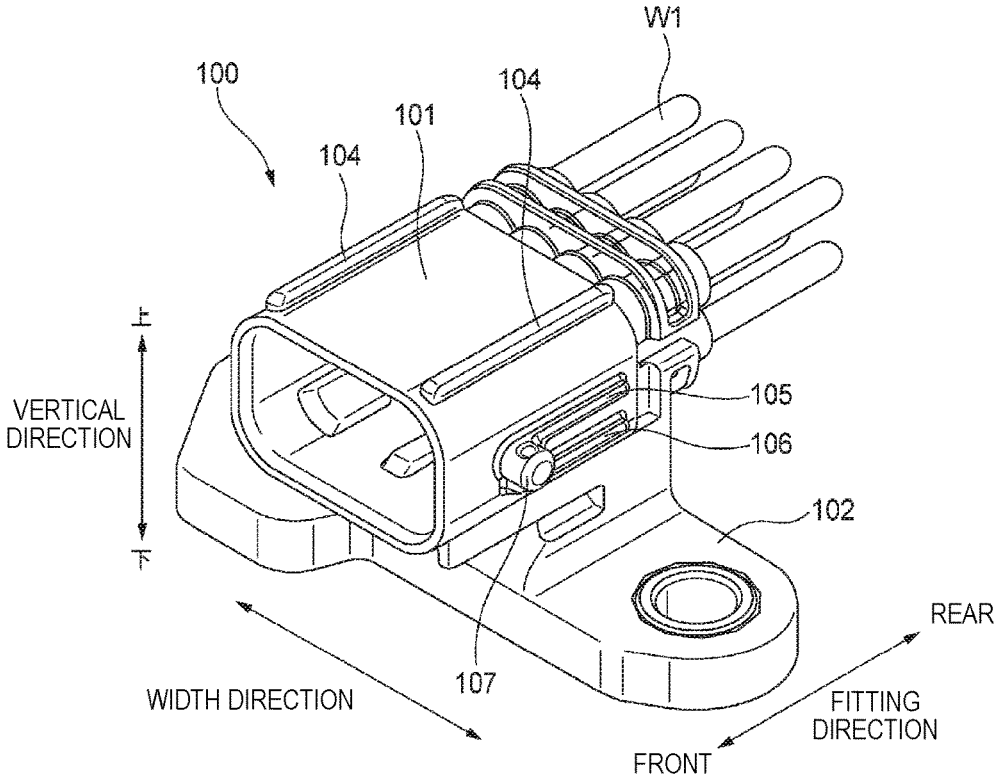
FIG. 1A is a perspective view of a male housing constituting a lever-type connector according to an embodiment of the invention, when viewed from the front.
Figure 1B:
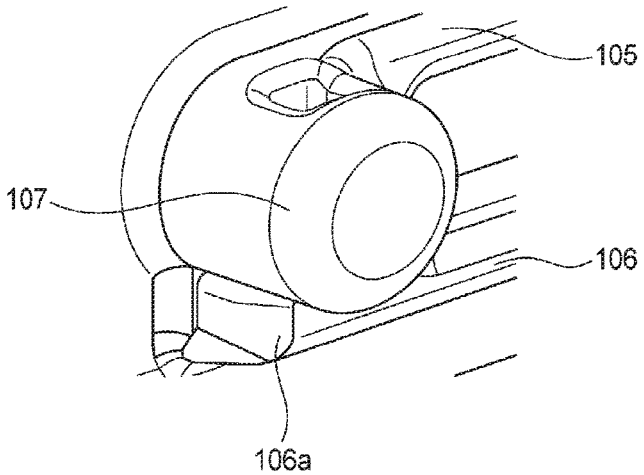
FIG. 1B is an enlarged perspective view of the periphery of a cam boss shown in FIG. 1A.
Figure 2A:
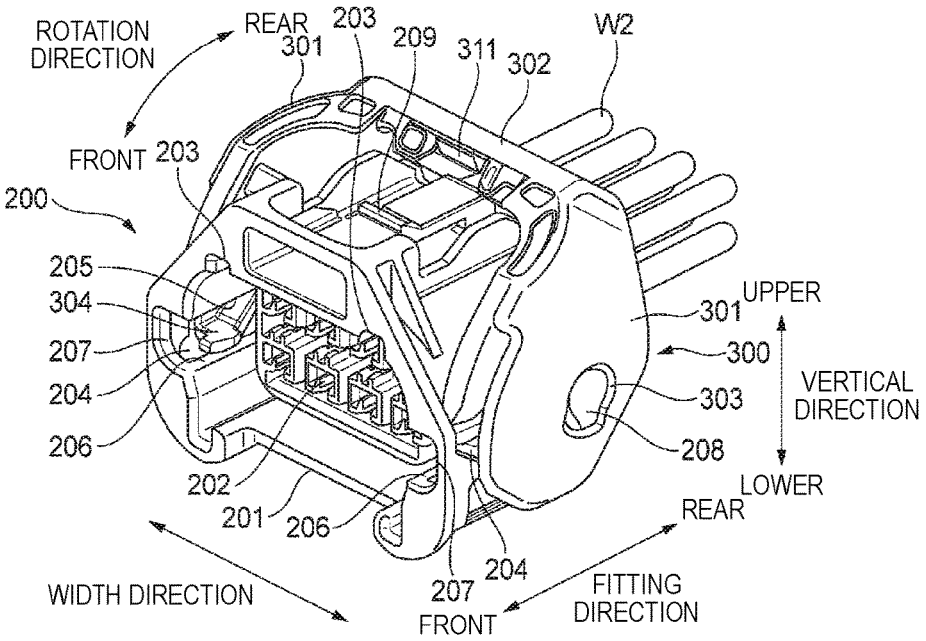
FIG. 2A is a perspective view of a female housing constituting the lever-type connector according to the embodiment of the invention, when viewed from the front.
Figure 2B:
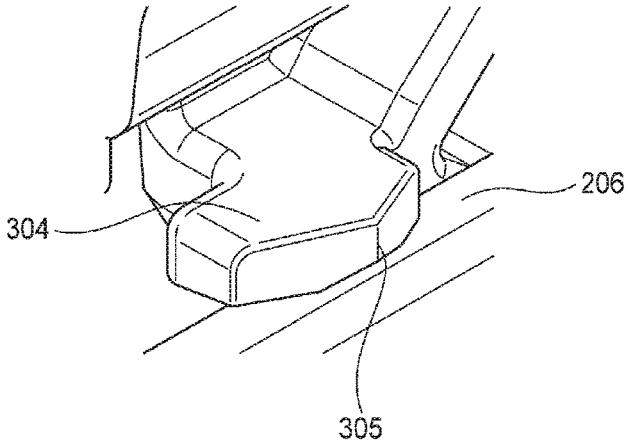
FIG. 2B is an enlarged perspective view of the periphery of a lever side locking part shown in FIG. 2A.

The lever-type connector 1 according to an embodiment of the invention includes a male housing 100 shown in FIGS. 1A and 1B, a female housing 200 shown in FIGS. 2A and 2B which is fitted to the male housing 100 so as to store therein the male housing 100 (the male housing 100 is inserted into the female housing 200), and a lever 300 shown in FIGS. 2A and 2B to be rotatably mounted on the female housing 200.

As shown in FIGS. 1A and 2B, and FIGS. 2A and 2B, "fitting direction", "width direction", "vertical direction", 'front', 'rear', 'upper', 'lower' and the "rotation direction" of the lever 300 are defined here. The "fitting direction", "width direction" and "vertical direction" are orthogonal to each other. Further, "the fitting time between the male housing 100 and female housing 200" is also called "the fitting time" simply. FIGS. 2A and 2B shows a state where the lever 300 is in a temporary lock position (fitting start position), in which the lever 300 is rotated forward from the temporary lock position (fitting start position), whereby it moves toward a final lock position (fitting completion position).

As shown in FIG. 1A, the male housing 100 is made of resin, while it includes a square tubular main body peripheral wall part 101 long in the width direction and a stay part 102 extending in the width direction from the lower end of the main body peripheral wall part 101 integrally therewith. In the inside of the main body peripheral wall part 101, there are formed multiple storing chambers 103 (see FIG. 4A) which respectively extend along the fitting direction for storing therein multiple male terminals T1 (see FIG. 4A) respectively connected to the ends of multiple (in this embodiment, 8) electric wires W1.

In the vicinities of the two ends in the width direction of the upper surface of the main body peripheral wall part 101, there are formed a pair of upper surface ribs 104. The paired upper surface ribs 104 project in the upper direction and extend in the fitting direction in parallel to each other substantially over the whole areas of the main body peripheral wall part 101 in the fitting direction. In the upper and lower parts of the two side surfaces of the main body peripheral wall part 101, there are formed an upper rib 105 and a lower rib 106 which respectively project outward in the width direction and extend in the fitting direction in parallel to each other from the vicinity of the rear end of the main body peripheral wall part 101 up to a position existing slightly forward from the center in the fitting direction.

The main body peripheral wall part 101 includes, on the two side surfaces thereof, cam bosses 107 respectively. Each cam boss 107 is formed between the front ends of the upper rib 105 and lower rib 106 and projects outward in the width direction more greatly than the upper rib 105 and lower rib 106. As shown in FIG. 1B, the shape of the section of the cam boss 107 (the shape of the section orthogonal to the projecting direction of the cam boss 107) is an elliptical shape the major diameter of which extends along the fitting direction (see FIGS. 4A and 4B and others).

As shown in FIG. 2A, the female housing 200 is made of resin and includes a square tubular main body peripheral wall part 201 long in the width direction. In the fitting time, the male housing 100 and female housing 200 are fitted to each other in such a manner that the inner peripheral surface of the main body peripheral wall part 201 and the outer peripheral surface of the main body peripheral wall part 101 of the male housing 100 are overlapped with each other (see FIGS. 3 and 4A and 4B as well). In the inside of the main body peripheral wall part 201, there are formed multiple terminal storing chambers 202 (see FIG. 4A) along the fitting direction respectively for storing therein multiple female terminals T2 (see FIG. 4A) respectively connected to the ends of multiple (in this embodiment, 8) electric wires W2.

The main body peripheral wall part 201 has a pair of upper surface grooves 203 in the vicinities of the width-direction two ends of the inside surface of the upper wall thereof. The paired upper surface grooves 203 are recessed in the upper direction and extend from the front end of the main body peripheral wall part 101 toward the rear side thereof in the fitting direction in parallel to each other. The main body peripheral wall part 201 includes, in the two side walls thereof, windows (penetration holes) 204 respectively extending in the fitting direction. The upper edge surface 205 and lower edge surface 206 of the window 204 extend rearward from the front end of the main body peripheral wall part 101 in the fitting direction in parallel to each other. The main body peripheral wall part 201 includes, in the front ends of the inside surfaces of the two side walls thereof, side surface grooves 207 which respectively continue with the front ends of the upper edge surface 205 and the lower edge surface 206 of the window 204 and are recessed outward in the width direction.

In the fitting time, the paired upper surface ribs 104 of the male housing 100 are inserted/guided into the paired upper surface grooves 203 respectively, the paired cam bosses 107 of the male housing 100 pass through the paired side surface grooves 207, and the paired upper rib 105 and lower rib 106 of the male housing 100 are contacted/guided to the upper edge surfaces 205 and lower edge surfaces 206 of the paired windows 204 respectively.

At predetermined positions on the rear sides of the two side surfaces of the main body peripheral wall part 201, there are formed a pair of rotation shafts 208 which respectively project outward in the width direction. To the paired rotation shafts 208, there are fitted a pair of holes 303 (connecting parts where the lever 300 and female housing 200 are connected together) formed in the lever. Thus, the lever 300 is mounted on the female housing 200 in such a manner that it can rotate about the paired rotation shafts 208.

Figure 4A:
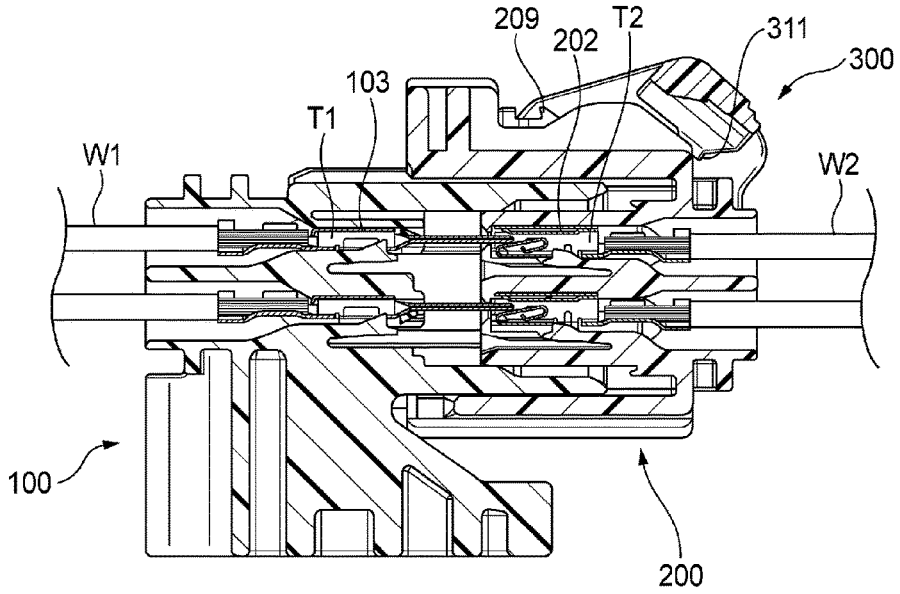
FIG. 4A is a section view taken along the arrow A-A shown in FIG. 3.

The main body peripheral wall part 201 includes a lock beak 209 which is formed in the width-direction central portion of the upper surface thereof and projects upward (see FIG. 4A as well). The lock beak 209 is provided so as to hold the lever 300, which simply exists in a final lock position, in the final locking position (the details of which are discussed later).

The main body peripheral wall part 201 includes, in the front side areas of the two side surfaces thereof, guide inclined surfaces 210 which are respectively inclined downward from the lower edge surface 206 of the window 204 and inward in the width direction (see FIGS. 4B to 6C). The function and the like of the guide inclined surface 210 are described later.

As shown in FIG. 2A, the lever 300 is made of resin and has a substantially U-like shape including a pair of side plate parts 301 and a connecting part 302 for connecting together one-side ends of the paired side plate parts 301. The paired side plate parts 301 respectively have a pair of holes 303 constituted of penetration holes. When the paired rotation shafts 208 of the female housing 200 are inserted into the paired holes 303 respectively, the lever 300 is enabled to rotate with respect to the female housing 200 (about the paired rotation shafts 208) in a state where the paired side plate parts 301 sandwich the two side surfaces of the female housing 200.

In the vicinity of the other ends (free ends) of the paired side plate parts 301, there are respectively formed lever side locking parts 304 integrally therewith which project inward in the width direction. As shown in FIGS. 2A and 2B, in a state where the lever 300 is at its temporary lock position, the paired lever side locking parts 304 respectively advance into the paired windows 204 and are locked in such a manner that they are sandwiched by the upper edge surface 205 and lower edge surface 206. Due to such locking of the lever side locking parts 304, the lever 300 is locked at its temporary lock position and is prohibited from moving to its final lock position.

Each lever side locking part 304 includes a projecting section 305 which projects inward in the width direction. In the fitting, the paired projecting sections 305 are pressed by the front end 106*a* (see FIG. 1B) of the lower rib 106 situated in the vicinity of the paired cam bosses 107 of the male housing 100 to rise onto the top of the lower rib 106, whereby the paired lever side locking parts 304 are elastically deformed outward in the width direction (see the arrow shown in FIG. 6B). As a result, the locking of the lever side locking parts 304 by the lower edge surface 206 is removed, thereby enabling the lever 300 to move forward in the rotation direction from the temporary lock position toward the final lock position.

Figure 4B:
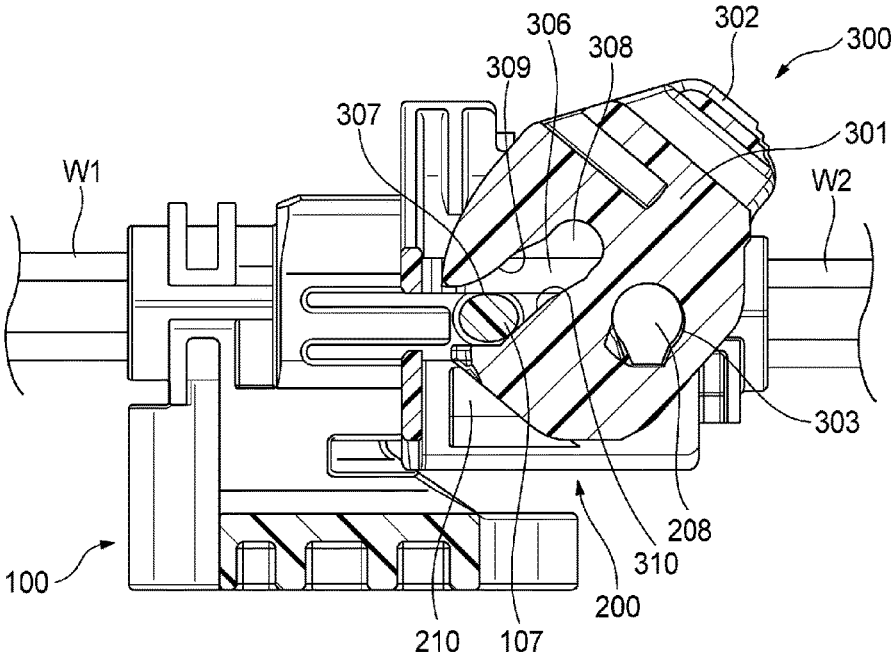
FIG. 4B is a section view taken along the arrow B-B shown in FIG. 3.

In the width-direction inside surfaces of the paired side plate parts 301, there are formed cam grooves 306 respectively (see, for example, FIG. 4B). The paired cam grooves 306 are formed such that, in the fitting time, as the lever 300 rotates from the temporary lock position to the final lock position, they draw the paired cam bosses 107 of the male housing 100 from the entrance parts 307 of the cam grooves 306 to the innermost parts 308 thereof (the details of which are described later). Here, each cam groove 306 is defined by a side wall 309 existing forward in the rotation direction and a side wall 310 continuous with the side wall 309 and existing rearward in the rotation direction.

In the width-direction central portion of the rotation-direction front end of the connecting part 302 of the lever 300, there is formed a lock beak holding section 311 (see FIGS. 2A and 4A). The lock beak holding section 311 cooperates with the lock beak 209 (see FIGS. 2A and 4A) of the female housing 200 to hold the lever 300, which simply exists at a final lock position, at the final lock position.

Specifically, when the lever 300 reaches the final lock position from the temporary lock position, the lock beak holding section 311 comes into contact with the lock beak 209 to hold it. As a result, the lever 300 existing at the final lock position is held at the final lock position. On the other hand, in this state, when the holding of the lock beak 29 by the lock beak holding section 311 is removed, the lever 300 is enabled to move from the final lock position toward the temporary lock position (backward in the rotation direction).

With reference to FIGS. 3 to 7, description is given below of the operation to fit the male housing 100 into the female housing 200.

Figure 5A:
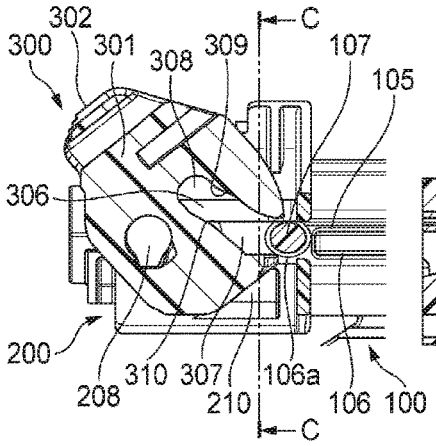
FIGS. 5A and 5B respectively show the position relationships between the cam boss and lever and between male and female terminals in a stage before the state of the start of the fitting between the male and female housings.
Figure 5B:
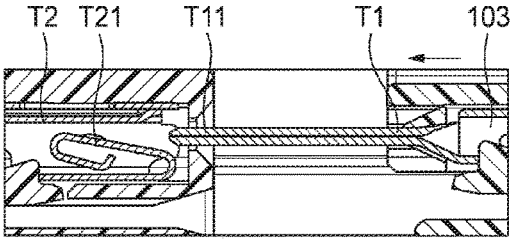

Firstly, with the lever 300 locked at the temporary lock position, the front surfaces of the female housing 200 and male housing 100 are arranged to face each other and, as shown in FIGS. 5A and 5B, the male housing 100 is inserted into the female housing 200. FIGS. 5A and 5B show a stage before the fitting is started.

In the stage shown in FIGS. 5A and 5B, the projecting sections 305 of the paired lever side locking parts 304 of the lever 300 are not yet pressed by the front ends 106*a* (see FIG.

Figure 6A:
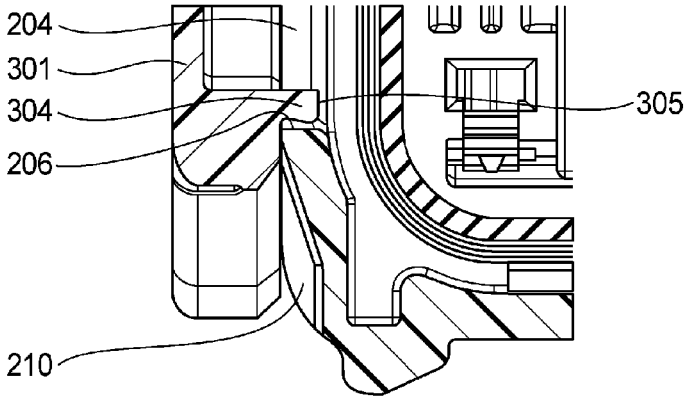
FIG. 6A is a section view taken along the arrow C-C shown in FIG. 5A.

1B) of the paired lower ribs 106 of the male housing 100. Therefore, as shown in FIG. 6A, the paired lever side locking parts 304 (the lower surfaces thereof) are locked to the lower edge surfaces 206 of the paired windows 204, thereby prohibiting the lever 300 from moving to the final lock position.

Also, in this stage, as shown in FIG. 5B, the leading end T11 of the male terminal T1 is not yet pressed into contact with the elastically deforming part T21 of the female terminal T2.

Figure 3:
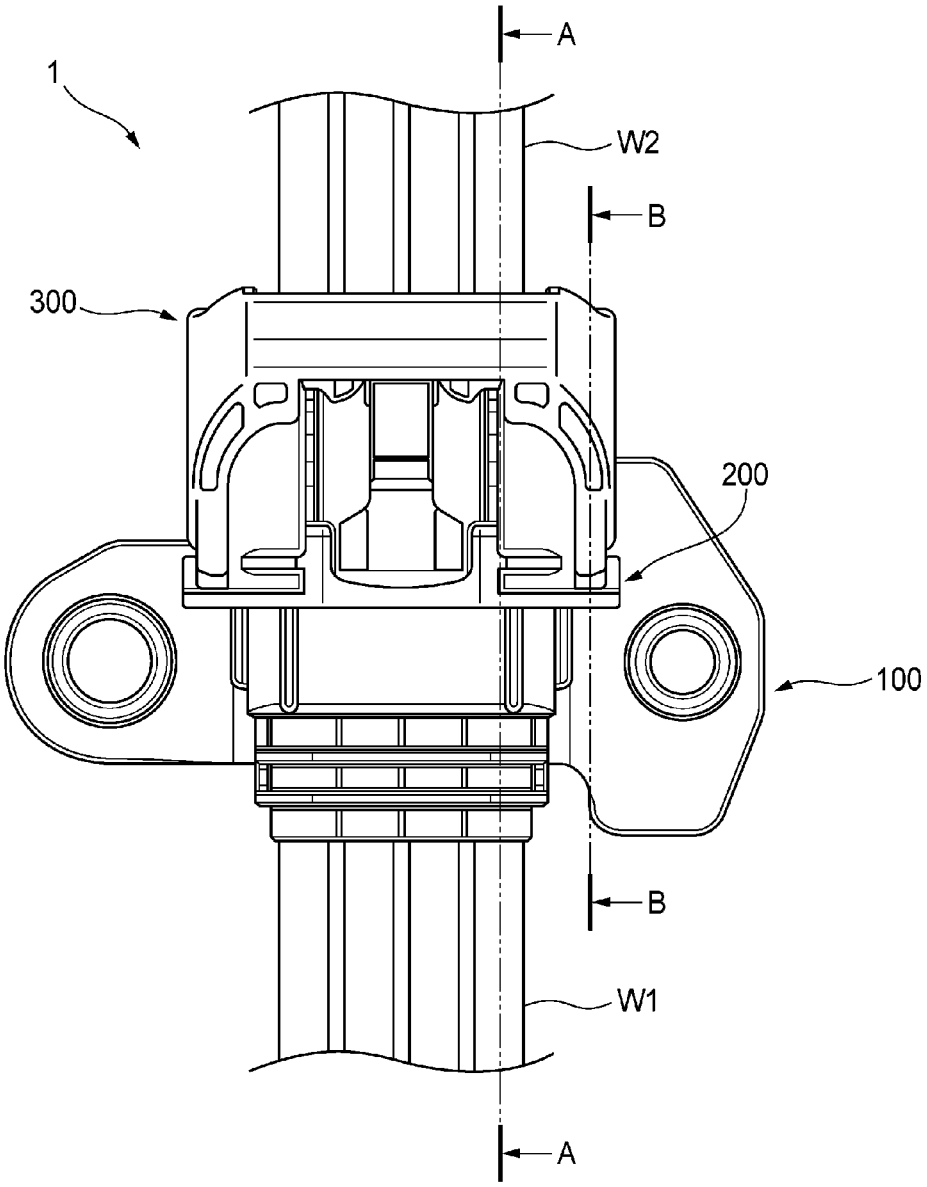
FIG. 3 is a plan view of a fitting start state between the male and female housings.
Figure 5C:
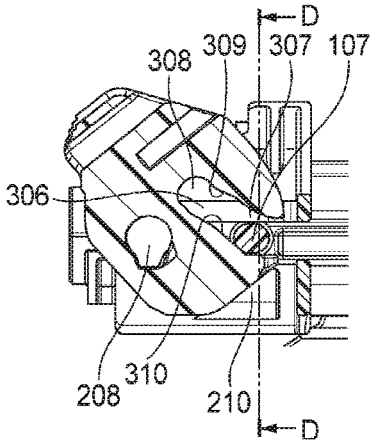
FIGS. 5C and 5D respectively show the position relationships between the cam boss and lever and between male and female terminals in the state of the start of the fitting between the male and female housings.
Figure 5D:
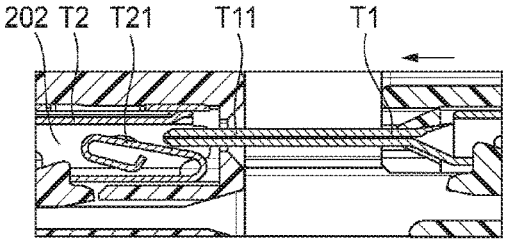

Next, as shown in FIGS. 5C and 5D, the male housing 100 is pressed further in the fitting direction with respect to the female housing 200 and is thereby inserted into a fitting start state (see FIG. 3 and FIGS. 4A and 4B as well). In the fitting start state, as shown in FIG. 5C, the paired cam bosses 107 of the male housing 100 are situated in the entrance parts 307 of the paired cam grooves 306 of the lever 300 and are starting to come into contact with the side walls 310 of the cam grooves 306.

Figure 6B:
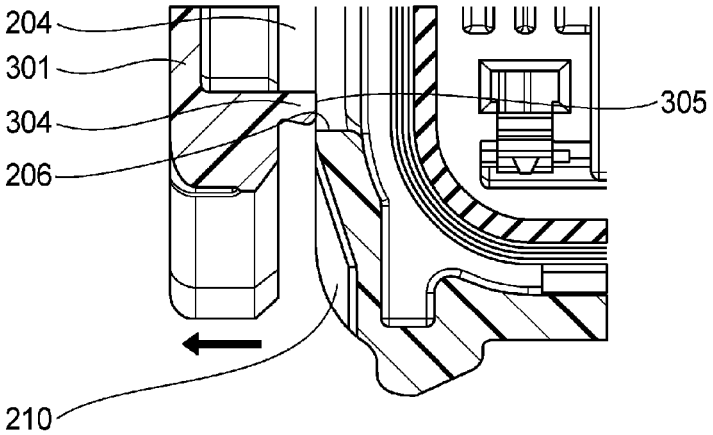
FIG. 6B is a section view taken along the arrow D-D shown in FIG. 5C.
Figure 7A:
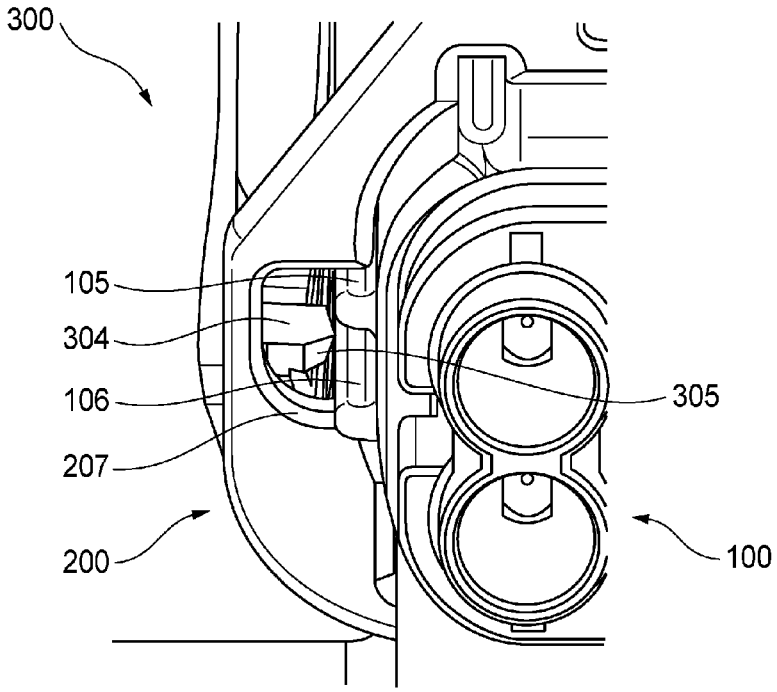
FIG. 7A is a perspective view of the state shown in FIG. 6B when viewed from the male housing side.
Figure 7B:
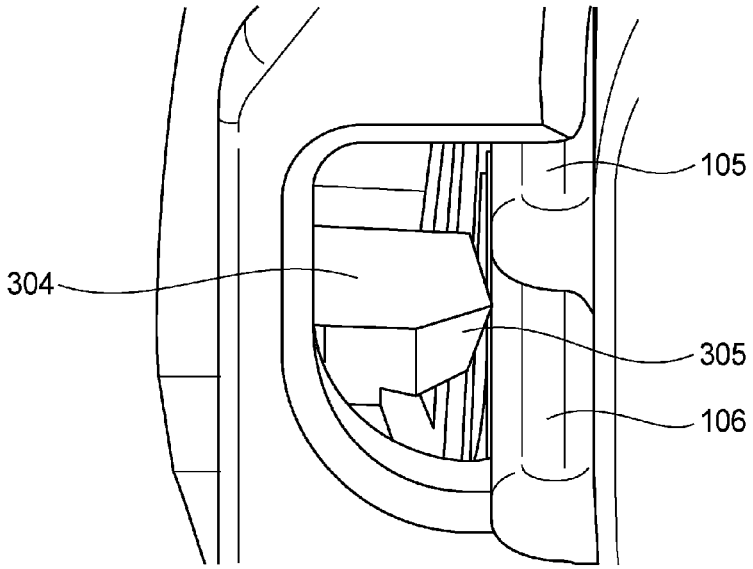
FIG. 7B is an enlarged perspective view of the periphery of a lever side locking part shown in FIG. 7A.

In the fitting start state, as shown in FIGS. 7A and 7B, since the projecting sections 305 of the paired lever side locking parts 304 are pressed by the front ends 106*a* of the paired lower ribs 106 to move onto the top parts of the paired lower ribs 106, as shown in FIG. 6B, the paired lever side locking parts 304 are elastically deformed outward in the width direction (see the arrow shown in FIG. 6B). Thus, the locking of the lever side locking parts 304 by the lower edge surfaces 206 is removed, thereby enabling the lever 300 to move from the temporary lock position to the final lock position. Here, as shown in FIG. 7B, since the projecting sections 305 of the paired lever side locking parts 304 slide on the top parts of the paired lower side ribs 106 in point contact therewith, its friction force is smaller than a case where it slides in surface contact, thereby enabling suppression of such an increase in the pressing force of the male housing 100 with respect to the female housing 200 as is caused by the sliding motion.

Also, in the fitting start state, as shown in FIG. 5D, the leading end T11 of the male terminal T1 is not yet pressed into contact with the elastic deformation part T21 of the female terminal T2. In other words, the cam boss 107 comes into contact with the side wall 310 of the cam groove 306 before the leading end T11 of the male terminal T1 is pressed into contact with the elastic deformation part T21 of the female terminal T2. This is because, when the shape of the section of the cam boss 107 is an elliptical shape the major diameter of which extends in the fitting direction, the contact timing of the cam boss 107 with the side wall 310 of the cam groove 306 is earlier than when the shape of the section of the cam boss 107 is a circular shape.

In the fitting start state, as described above, the lever 300 is in a state where it is able to move from the temporary lock positon to the final lock position. Therefore, in the fitting start state, when the male housing 100 is pressed further in the fitting direction with respect to the female housing 200, the cam boss 107 presses the side wall 310 of the cam groove 306, whereby the lever 300 starts to rotate from the temporary lock position toward the final lock position.

Here, in the case of a configuration where, in the fitting start state, the projecting section 305 of the lever side locking part 304 comes into contact with such portion of the top surface of the lower rib 106 as is inclined downward and inward in the width direction, when the elastically deformed projecting section 305 of the lever side locking part 304 presses (the inclined portion of) the top surface of the lower rib 106, the projecting section 305 receives a downward reaction force. On receiving this reaction force, the lever 300 starts to rotate from the temporary lock positon toward the final lock position. In this case, the male housing 100 need not be pressed in the fitting direction with respect to the female housing 200 in order to start the rotation of the lever 300 from the temporary lock positon toward the final lock position.

Figure 5E:
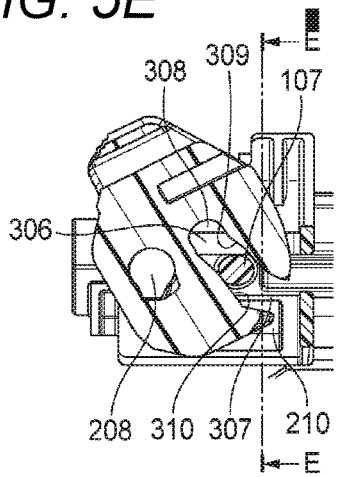
FIGS. 5E and 5F respectively show the position relationships between the cam boss and lever and between male and female terminals in a stage after the state of the start of the fitting between the male and female housings.
Figure 5F:
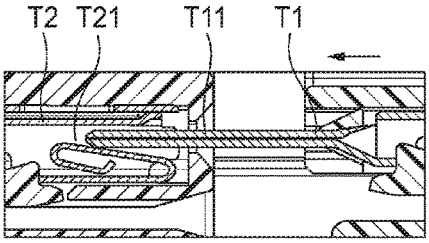
Figure 6C:
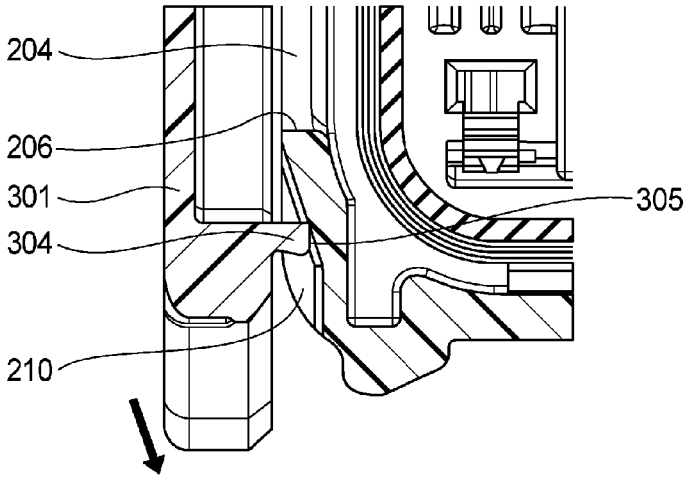
FIG. 6C is a section view taken along the arrow E-E shown in FIG. 5E.

When the lever 300 starts to rotate from the temporary lock positon toward the final lock position in this manner, as shown in FIGS. 5E, 5F and 6C, the elastically deformed projecting sections 305 of the paired lever side locking parts 304 move onto the paired guide inclined surfaces 210 of the female housing 200 (see FIGS. 4B to 6C as well) and press the guide inclined surfaces 210 while recovering elasticity.

Here, as described above, the guide inclined surfaces 210 extend while being inclined downward and inward in the width direction. Thus, when the elastically deformed projecting sections 305 of the paired lever side locking parts 304 press the guide inclined surface 210 while recovering elasticity, the projecting sections 305 receive a downward reaction. On receiving this reaction force, the lever 300 receives a force going forward in the rotation direction (toward the final lock position). In other words, just after removal of the locking by the lower edge surfaces 206 of the lever side locking parts 304, a rotation assist effect is given to the lever 300 by the guide inclined surface 210. This rotation assist effect enhances the operation feeling just after the lever 300 starts to rotate from the temporary lock positon toward the final lock position.

After the lever 300 starts to rotate from the temporary lock positon toward the final lock position, the lever 300 rotates toward the final lock position while receiving the rotation assist effect. Thus, since the side walls 309 of the cam grooves 306 press the cam bosses 107 toward the back side of the female housing 200, in accordance with the progress of the rotation of the lever 300, the cam bosses 107 (and eventually the male housing 100) are drawn toward the back side of the female housing 200 (see FIG. 5E).

With the progress of the rotation of the lever 300, the projecting sections 305 of the paired lever side locking parts 304 slide on the guide inclined surfaces 210. In this case, as shown in FIG. 6C, the projecting sections 305 slide on the guide inclined surfaces 210 in point contact therewith. Therefore, a frictional resistance is smaller than when they slide in surface contact, thereby enabling suppression of such an increase in the pressing force of the male housing 100 with respect to the female housing 200 as is caused by the sliding motion of the projecting sections.

The above rotation assist effect decreases gradually as the amount of the elastic deformation of the lever side locking parts 304 decreases with the progress of the forward rotation of the lever 300 in the rotation direction. In this embodiment, as shown in FIGS. 5E and 6C, around the time when the forward rotation of the lever 300 in the rotation direction progresses and the lever side locking parts 304 recover elasticity completely (that is, around the time when the rotation assist effect disappears), as shown in FIG. 5F, the leading end T11 of the male terminal T1 is pressed into contact with the elastic deformation part T21 of the female terminal T2.

Even after the leading end T11 of the male terminal T1 is pressed into contact with the elastic deformation part T21 of the female terminal T2, when the lever 300 is rotated further toward the final lock position, the side walls 309 of the cam grooves 306 press further the cam bosses 107 toward the back side of the female housing 200, whereby, in accordance with the progress of the rotation of the lever 300, the cam bosses 107 (and eventually the male housing 100) are drawn further toward the rear side of the female housing 200.

And, when the lever 300 reaches the final lock position, the cam bosses 107 reach the deep-most parts of the cam grooves 306 (see FIGS. 4A and 4B and FIGS. 5A to 5F), the male housing 100 is brought into a fitting completion state and, as described above, the lock beak holding part 311 of the lever 300 (see FIG. 4A) is contacted with the lock beak 209 of the female housing 200 (see FIG. 4A) to hold it. This completes conduction connection between the male terminal T1 and female terminal T2 respectively provided in the male housing 100 and female housing 200 (see FIG. 4A), and the lever 300 is held at the final lock position.

Figure 8:
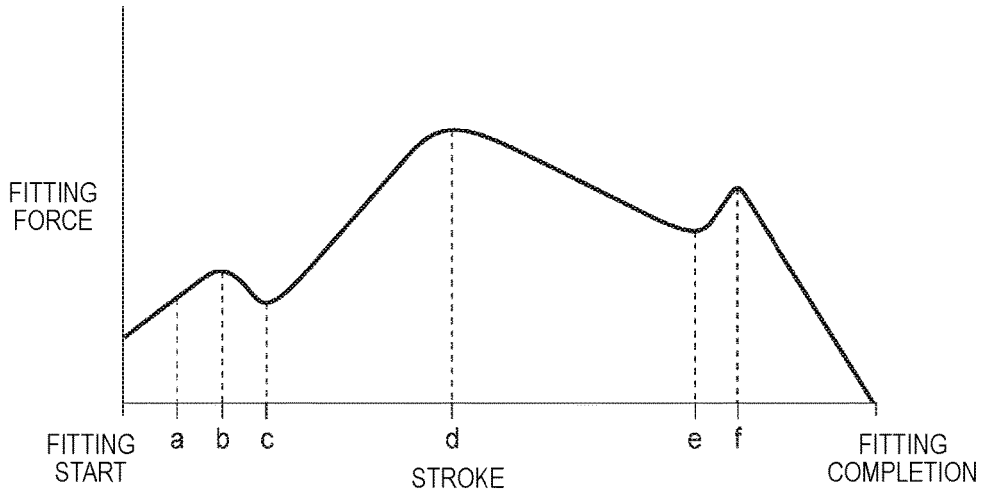
FIG. 8 is a graph of an example of the transition of a fitting force from the start of the fitting to the completion of the fitting between the male and female housings.

Referring to FIG. 8, additional description is given below of an example of the relationship, in the fitting time, between the amount of the movement (which is hereinafter called [stroke]) of the male housing 100 in the fitting direction from a state where the positions of the front surfaces of the male housing 100 and female housing 200 coincide with each other, and the pressing force (fitting force) of the male housing 100 required for the movement thereof in the fitting direction with respect to the female housing 200.

In FIG. 8, a stroke a corresponds to a timing when the pressing of the projecting sections 305 of the lever side locking parts 304 by the front ends 106*a* (see FIG. 1B) of the lower ribs 106 of the male housing 100 is started (that is, when the elastic deformation of the lever side locking parts 304 is started). A stroke b corresponds to the above-mentioned fitting start state (a state where the amount of the elastic deformation of the lever side locking parts 304 increases to remove the locking by the lower edge surfaces 206 of the lever side locking parts 304, and the cam bosses 107 start to come into contact with the cam grooves 306). A stroke c corresponds to a timing when the lever side locking parts 304 recover elasticity completely and the leading ends T11 of the male terminal T1 are pressed into contact with the elastic deformation parts T21 of the female terminal T2. A stroke d corresponds to a timing when the amount of the elastic deformation of the elastic deformation parts T2 of the female terminal T2 caused by the press insertion of the leading ends of the male terminal T1 is maximized. A stroke e corresponds to a timing when the holding operation of the lock beak 209 by the lock beak holding part 311 is started. A stroke f corresponds to a timing (that is, the above-mentioned fitting completion state) when the holding operation of the lock beak 209 by the lock beak holding part 311 is completed.

As shown in FIG. 8, even before the stroke a, the pressing force changes so as to increase gradually due to a frictional force produced during the sliding motion of the housings (a frictional force produced during the sliding motion of the main body peripheral parts 101 and 201) or the like. From the stroke a to the stroke b, a reaction force going inward in the width direction to be received by the male housing 100 increases in accordance with an increase in the elastic deformation amount of the lever side locking part 304, whereby the pressing force increases. From the stroke b to the stroke c, the pressing force decreases due to the above-mentioned rotation assist effect. From the stroke c to the stroke d, the press-insertion resistance increases in accordance with such an increase in the elastic deformation amount of the elastic deformation part T21 of the female terminal T2 as is caused by the press insertion of the leading end T11 of the male terminal T1, whereby the pressing force increases. From the stroke d to stroke e, the pressing force decreases due to, for example, a decrease in the sliding resistance between the cam boss 107 and cam groove 306 caused by the shape or the like of the cam groove 306. And, from the stroke e to the stroke f, the pressing force increases due to an increase in the resistant force caused by the holding operation of the lock beak holding part 311 to hold the lock beak 209.

As described above, according to the lever-type connector 1 in accordance with the embodiment of the invention, in the fitting time, the cam bosses 107 of the male housing 100 come into contact with the cam grooves 306 of the lever 300 before the male terminal T1 is press inserted into the female terminal T2. In other words, the timing when the size of the force required for the fitting is increased due to the start of the press contact of the male terminal 1 can be made different from the timing when the size of the force required for the fitting is increased due to the start of rotation of the lever 300 by the cam boss 107. Therefore, when compared with an embodiment where the press contact of the male terminal T1 and the rotation start of the lever 300 by the cam boss 107 are performed in the same timing, the size of an increase in the force required for the fitting at the same time can be reduced.

Therefore, the lever-type connector 1 of the embodiment can suppress large variations in the force required for the fitting and thus can enhance the fitting workability.

In addition, the section shape of the cam boss 107 provides an elliptical shape the major diameter of which extends along the fitting direction (see FIG. 1B). Thus, when compared with a case where the section shape of the cam boss 107 provides a circular shape, the timing of the contact of the cam boss 107 with the cam groove 306 of the lever 300 can be advanced. As a result, without changing the position of the cam boss 107, the timing of the press contact of the male terminal T1 and the timing of the rotation start of the lever 300 by the cam boss 107 can be made different from each other.

<Other Embodiments>

Here, the invention is not limited to the above embodiment but various modifications, improvements and the like can be employed properly within the scope of the invention. Also, the materials, shapes, dimensions, number, arrangement locations etc. of the respective composing elements of the above embodiment are arbitrary but not limitative so long as they can attain the invention.

For example, in the above embodiment, the projecting section 305 of the lever side locking part 304 of the lever 300 slides on the guide inclined surface 210 of the female housing 200 in point contact therewith (see FIG. 6C). However, the shape of the projecting section 305 may also be designed in such a manner that the projecting section 305 slides on the guide inclined surface 210 of the female housing 200 in line contact therewith. The thus-designed shape can also reduce the frictional resistance when compared with the surface contact sliding motion, thereby enabling suppression of such an increase in the pressing force of the male housing 100 with respect to the female housing 200 as is caused by the sliding motion.

Here, the characteristics of the embodiment of the lever-type connector 1 according to the invention are briefly listed as the following configurations (1) and (2).

(1) A lever-type connector (1) comprising:

a first housing (100) and a second housing (200) which are capable of being fitted to each other; and a lever (300) mounted on the second housing, wherein the first housing (100) includes a first terminal storage chamber (103) capable of storing a first terminal (T1) therein, and a cam boss (107) which moves together with the first housing in a fitting direction when the first housing (100) and the second housing (200) are fitted to each other, wherein the second housing (200) includes a second terminal storage chamber (202) capable of storing a second terminal (T2) therein, wherein the lever (300) includes a cam groove (306) capable of receiving the cam boss, and wherein the lever approximates the first housing and the second housing to each other and brings the first terminal and the second terminal into press contact with each other while moving the cam boss along the cam groove, wherein the cam boss (107) and the cam groove (306) are brought into contact with each other, before the first terminal (T1) and the second terminal (T2) are press contacted with each other.

(2) The lever-type connector according to the above configuration (1), wherein the cam boss (107) has an elliptical cross-sectional shape in which a major diameter extends along the fitting direction.

DESCRIPTION OF REFERENCE NUMERALS AND SIGNS

1: Lever-type connector
100: Male housing (first housing)
103: Terminal storage chamber (first terminal storage chamber)
107: Cam boss
200: Female housing (second housing)
202: Terminal storage chamber (second terminal storage chamber)
300: Lever
306: Cam groove
T1: Male terminal (first terminal)
T2: Female terminal (second terminal)

What is claimed is:

1. A lever-type connector comprising:

a first housing and a second housing which are capable of being fitted to each other; and a lever which is mounted on the second housing and is enabled to move from a fitting start position to a fitting completion position, wherein the first housing includes a first terminal storage chamber capable of storing a first terminal therein, and a cam boss which moves together with the first housing in a fitting direction when the first housing and the second housing are fitted to each other, wherein the cam boss has an elliptical cross-sectional shape in which a major diameter extends along the fitting direction, wherein the second housing includes a second terminal storage chamber capable of storing a second terminal therein, wherein the lever includes a cam groove capable of receiving the cam boss, wherein the lever approximates the first housing and the second housing to each other and brings the first terminal and the second terminal into press contact with each other while moving the cam boss along the cam groove, wherein the lever includes a lever side locking part, wherein the lever side locking part is configured to be elastically deformed to a first direction away from a surface of the second housing and to be locked to a housing side locking part provided at the second housing when the lever is positioned at the fitting start position, wherein the housing side locking part is a lower edge surface of the lever side locking part, wherein the first housing includes a pressing part, wherein the pressing part is configured to move to the fitting direction with the first housing when the first housing and the second housing are fitted to each other, to remove the locking of the lever side locking part and the housing side locking part by pressing and elastically deforming the lever side locking part to the first direction, and is positioned at a side of the second housing of the cam boss, wherein the second housing includes a guide inclined surface, wherein the guide inclined surface is adjacent to the housing side locking part, wherein the guide inclined surface is configured to accept the lever side locking part in which the locking to the housing side locking part is released by the pressing of the pressing part, and is inclined so that the lever moves to the fitting completion position when the lever side locking part recovers elastically and presses the guide inclined surface, wherein the cam boss and the cam groove are brought into contact with each other, before the first terminal and the second terminal are press contacted with each other, and wherein, when the lever side locking part completely recovers elastically by moving on the guide inclined surface of the lever side locking part, the first terminal and the second terminal are configured to start pressing contact to each other.

2. The lever-type connector according to claim 1, wherein, when the first housing and the second housing are at an initial fitting position, the cam groove extends at an angle greater than 0° and less than 180° relative to the fitting direction.

3. The lever-type connector according to claim 1, wherein the lever brings the first terminal and the second terminal into press contact with each other while moving the cam boss along the cam groove while moving towards the first housing in the fitting direction.

4. The lever-type connector according to claim 1, wherein the cam boss remains within the cam groove when the first housing and the second housing are at a final fitting position.

5. The lever-type connector according to claim 1, wherein the lever further includes a projection portion projecting toward the second housing when the first housing and the second housing are at an initial fitting position.

6. The lever-type connector according to claim 5, wherein the first housing includes a first projection contact portion and a second projection contact portion connected by an inclined surface, and wherein the projection portion is configured to progress from directly contacting the first projection contact portion to directly contacting the second projection contact portion as the first housing and the second housing move from the initial fitting position to a final fitting position.

* * * * *